US005355751A

United States Patent [19]

Specht

[11] Patent Number: 5,355,751

[45] Date of Patent: Oct. 18, 1994

[54] MOTOR-DRIVEN WRENCH

[75] Inventor: Wolfgang Specht, Gaildorf, Fed. Rep. of Germany

[73] Assignee: Robert Bosch GmbH, Stuttgart, Fed. Rep. of Germany

[21] Appl. No.: 23,567

[22] Filed: Feb. 26, 1993

Related U.S. Application Data

[63] Continuation-in-part of Ser. No. 851,648, Mar. 16, 1992, abandoned.

[30] Foreign Application Priority Data

Mar. 16, 1991 [DE] Fed. Rep. of Germany ... 9103252[U]

[51] Int. Cl.[5] ..... B25B 21/00

[52] U.S. Cl. ..... 81/57.14; 81/57.3

[58] Field of Search ..... 81/57.14, 57.3, 57.11, 81/57, 57.13, 57.15, 57.16, 57.28, 57.29, 57.31, 57.33, 57.34

[56] References Cited

U.S. PATENT DOCUMENTS

| | | | |
|---|---|---|---|
| 3,535,960 | 10/1970 | Borries | 81/57.14 |
| 3,602,071 | 8/1971 | Juhasz | 81/57.14 |
| 3,987,692 | 10/1976 | Lesner et al. | 81/57.13 |
| 4,064,772 | 12/1977 | Boyd et al. | 81/57.13 |
| 4,357,843 | 11/1982 | Peck et al. | 81/57.16 |
| 4,674,366 | 6/1987 | Lauer et al. | 81/57.14 |
| 5,048,377 | 9/1991 | Varis | 81/57.3 X |

*Primary Examiner*—D. S. Meislin
*Attorney, Agent, or Firm*—Michael J. Striker

[57] ABSTRACT

A motor-driven wrench has an open rotatable wrench wheel having a wrench opening and an engaging formation, and a drive for rotary driving the wrench wheel and having at least two engaging portions which engage the engaging formation of the rotary wheel and are spaced from one another by a distance which is greater than a width of the wrench opening, a marking for identifying a position of the wrench opening, and a sensor recognizing the marking and controlling the position of the wrench wheel.

17 Claims, 4 Drawing Sheets

MOTOR-DRIVEN WRENCH

CROSS-REFERENCE TO RELATED APPLICATION

This application is a continuation-in-part of patent application Ser. No. 851,648 filed on Mar. 16, 1992.

BACKGROUND OF THE INVENTION

The present invention relates to a motor-driven wrench.

More particularly, it relates to such a wrench which has an open wrench wheel with a friction surface or toothing.

In such known wrenches the open wrench wheels are rotated by means of a plunger or ratchet. The rotation is performed either only in one direction or, after switching a bar, can be changed. For changing the rotary direction the wrench must be either turned by 180° or changed over with a bar. Both approaches increase the cycle time in automatic manufacturing processes.

SUMMARY OF THE INVENTION

Accordingly, it is an object of the present invention to provide a wrench of the above mentioned general type, which avoids the disadvantages of the prior art.

In keeping with these objects and with others which will become apparent hereinafter, one feature of the present invention resides, briefly stated, in a wrench in which a marking indicates the position of the wrench opening, and a sensor senses the marking and controls the wrench wheel.

When the wrench is designed in accordance with the present invention not only has it a greater wrench opening than in the wrenches of the prior art, but also it permits a delay-free changing over the rotary direction.

This facilitates the screwing of double threads pin with both a right thread and a left thread, such as for example cross ties of motor vehicles. The reverse of the rotary direction during pulling of the wrench is known to be of advantage. Also, before the screwing process itself, it is desirable to allow the wrench to rotate in an opposite direction for finding the thread.

In accordance with another especially advantageous feature of the present invention the width of the wrench openings substantially corresponds to the width of the wrench wheel whereby during respective positioning of the wrench wheel the wrench can be removed from the screw or nut to be tightened without lateral displacement.

In accordance with still another especially advantageous feature of the present invention, the drive train between the motor and the wrench wheel is provided with a marking formed for example as a pin on the wrench wheel. With such a marking the position of the wrench wheel can be easily recognized by a sensor.

The sensor can be formed as a contactless initiator which sends an electric pulse to an operational control when a metal part comes to a proximity.

The drive of the wrench can be provided by an electrically commutated EC motor. Such motor has a faster switching of the rotary direction than compressed air motor. EC motors provide for especially well controlled and shortest reaction times and do not run during switching off.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
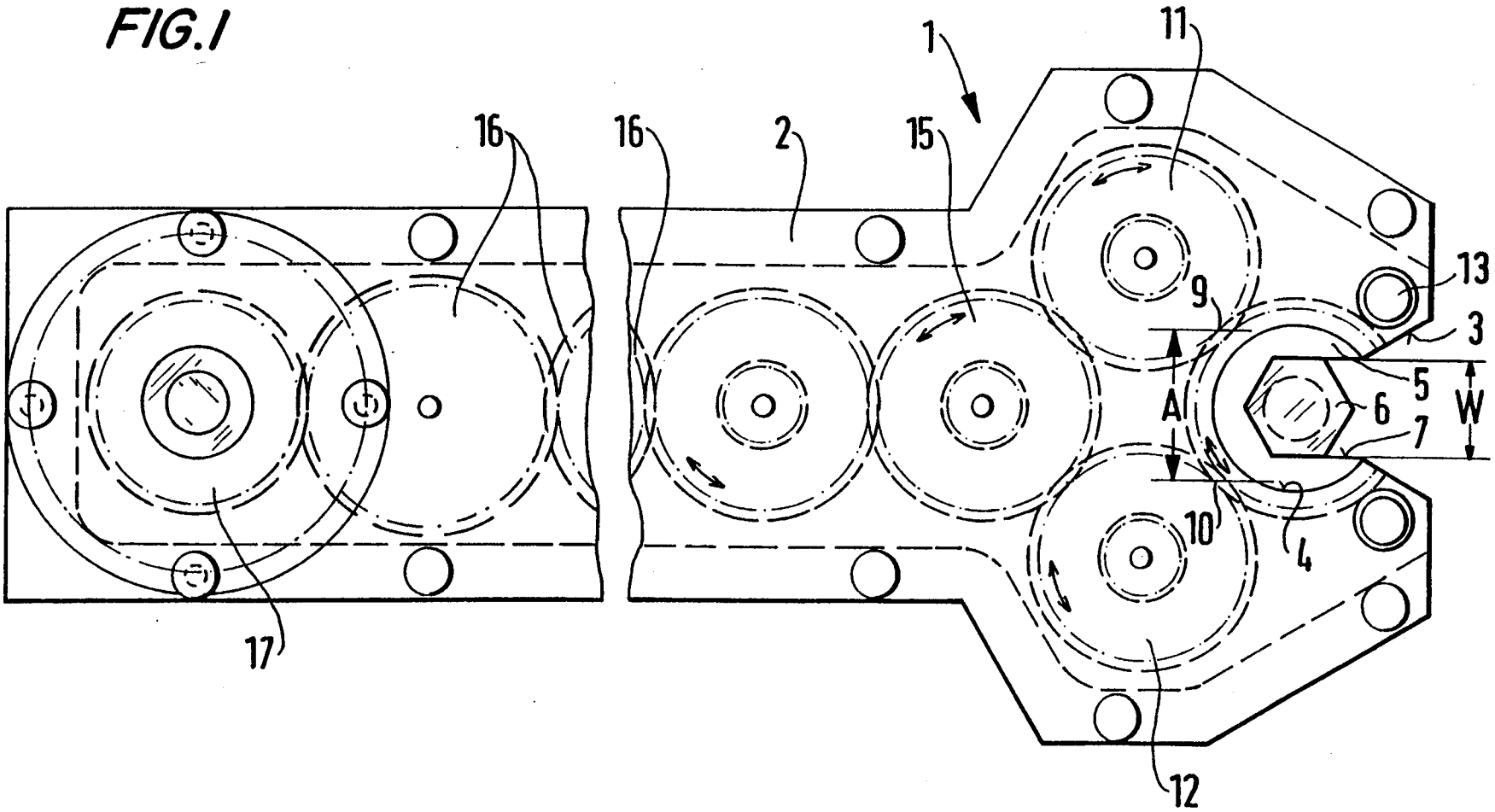
FIG. 1 is a view showing a longitudinal section of a wrench in accordance with the present invention.

A wrench in accordance with the present invention is identified with reference numeral 1 as a whole. It has an elongated housing 2. One end of the housing 2 has a recess 3 which ends in an opening 4. A wrench wheel 5 is supported in the opening and has a preselectable wrench width to engage a nut or a screw 6 at three sides. For placing on the nut 6, the wrench wheel has a wrench opening 7 with a width W which corresponds to the selected wrench width. The wrench wheel 5 has a periphery provided with a toothing 8.

Two engaging points 9 and 10 of two toothed wheels 11 and 12 engage in the toothing 8 of the wrench wheel 5. The distance A between the engaging points 9 and 10 is greater than the width W of the wrench opening 7. It is thereby guaranteed that with the rotary drive of the wrench wheel 5, at least one toothed wheel 11, 12 is always in engagement with the toothing 8. Two supporting wheels 13 are associated with the engaging points 9 and 10 and arranged at opposite sides. The supporting wheels 13 are preferably supported by ball bearings.

The gear wheels 11 and 12 are in engagement with a joint drive wheel 15 and driven by it. Several driving wheels 16 are arranged in a row in the shaft-like housing 2 behind the drive wheel 15. They form a drive train up to the driven wheel 17 of an electrically commutating electric motor 25.

Figure 2:
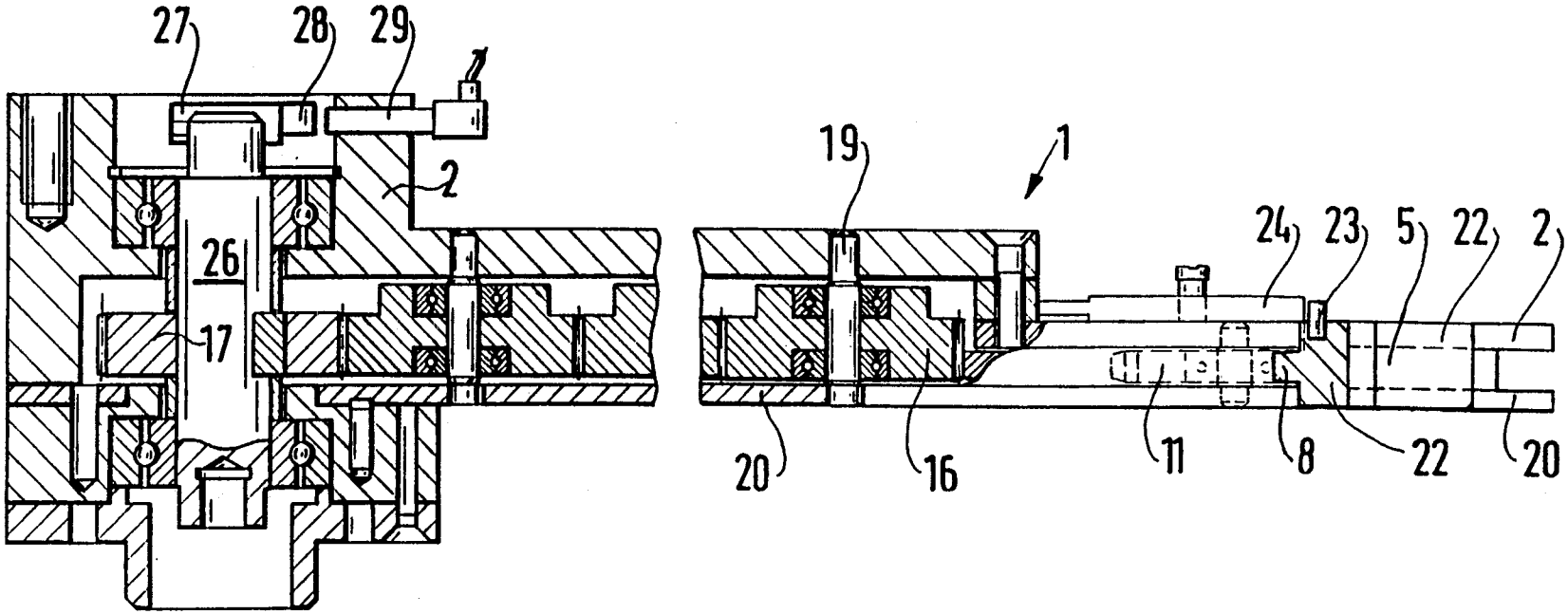
FIG. 2 is a view showing a transverse section of the inventive wrench.

FIG. 2 schematically shows the housing 2. Only the frontmost driving wheel 16 is shown in this Figure and supported on the pin 19. The pin is arranged in opposite openings in the housing 2 and in a housing cover 20. The not shown drive wheel 15 and the toothed wheel 11 are supported in the same way. The wrench wheel 5 has a bearing pin 22 engaging in the housing 2 under the housing cover 20. The bearing pins 22 have a diameter corresponding to the diameter of the opening 4. The toothing of the wrench wheel 5 extends radially beyond the bearing pins 22 so that the wrench wheel 5 can be secured from falling out. The wrench wheel 5 carries a pin 23 at its side opposite to the wrench opening 7. The pin 23 extends outwardly beyond one of the bearing pins 22. The pin 23 serve as a marking for the position of the wrench opening. The position of the pin 23 is sensed by a sensor 24 mounted on the housing 2. The sensor 24 can be preferably formed as a contactless initiator. The recognition device for the position of the wrench opening can be also arranged at a different part of the wrench as will be described hereinbelow.

The drive wheel 17 of the electric motor 25 is for example mounted on the housing 2, sits on a shaft 26. The shaft 26 can be supported in two ball gearings. At the side opposite to the motor the shaft 26 can support the recognition device for the position of the wrench opening alternatively to the arrangement in the region of the wrench wheel 5. This is made possible due to the slippage free device train formed by the gear wheels from the wrench wheel 5 to the driven wheel 17. An element 27 with a projection 28 extending at one side in a radial direction and forming a marking, is arranged on the shaft 26. A sensor 29 is accommodated in the housing 2 and located exactly opposite to the projection 28 during the open position of the wrench 1.

Figure 3:
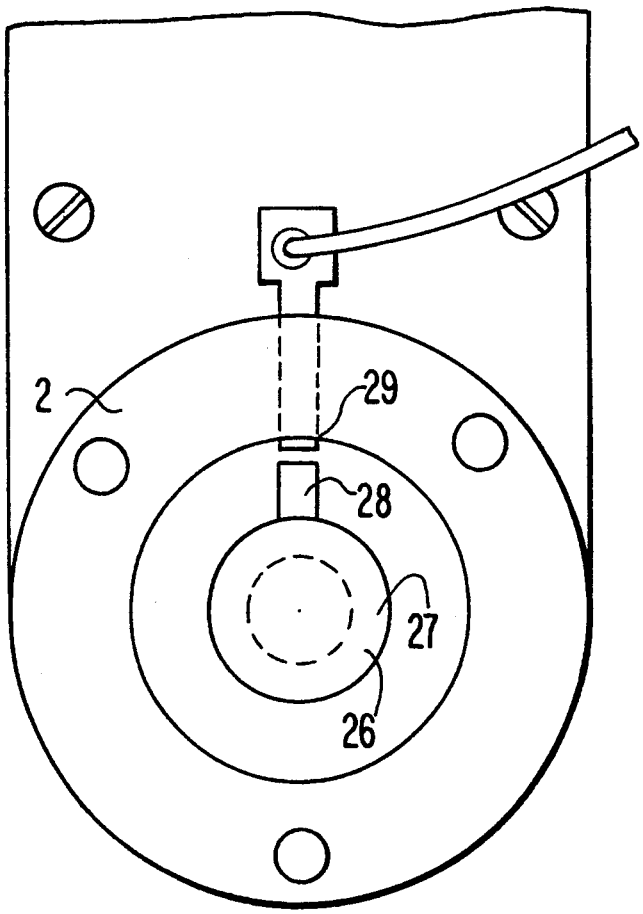
FIG. 3 is a view showing a unit for recognition of a wrench opening position.

This can be seen in FIG. 3. The markings 23, 28 on the wrench wheel 5 or on the shaft 26 which co-rotates with the wrench wheel 5 are arranged so that it is located exactly opposite to the sensor 24, 29 correspondingly when the wrench 1 is in a position in which it is open.

The sensor 29 as well as the sensor 24 are formed preferably as inductive proximity switches.

Figure 4:
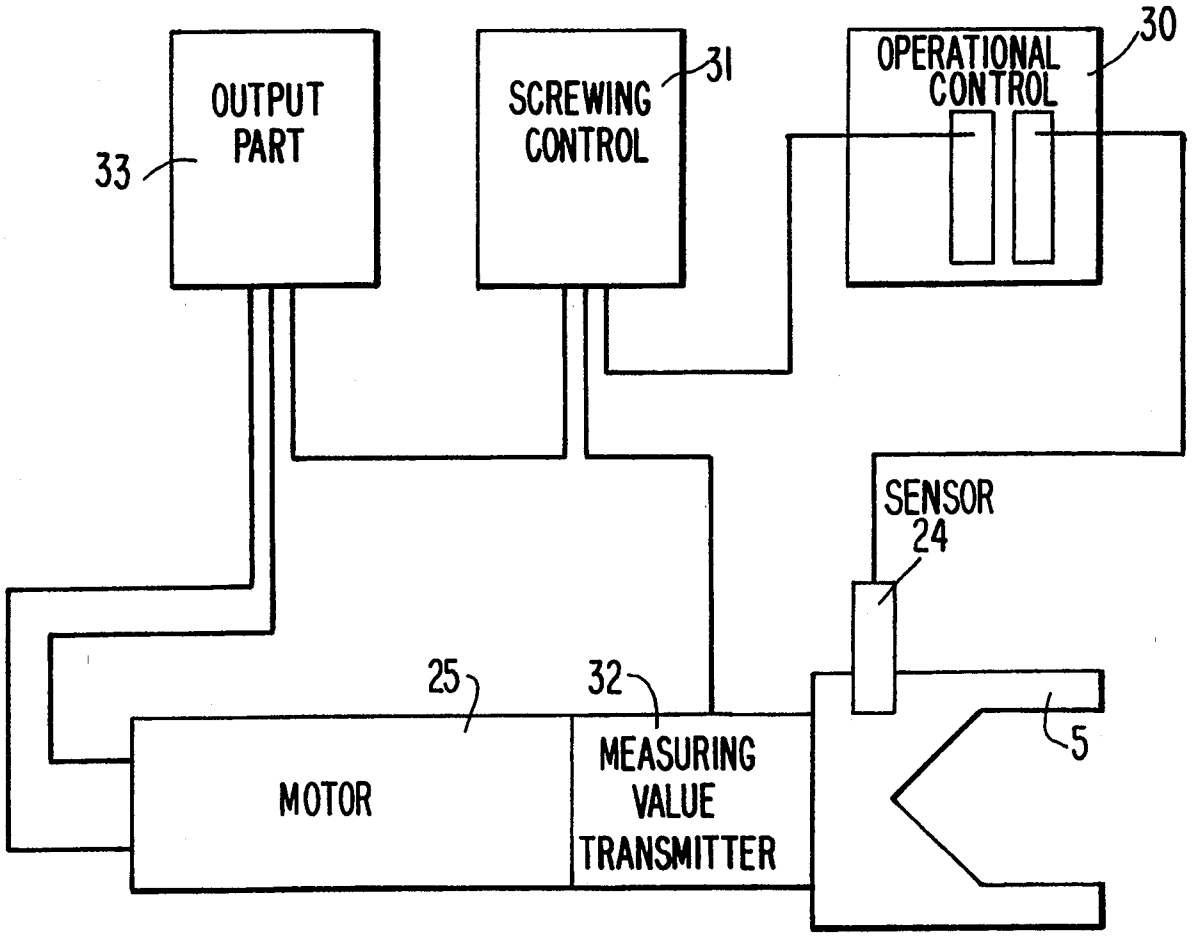
FIG. 4 is a view showing a control diagram of the inventive wrench.

During screwing every time when the wrench wheel 5 is open, the sensor 24 supplies a signal to an electronic operational control 30 shown in FIG. 4. The operational control receives the signal of the sensor and supplies it in a processed form to an electronic screwing control 31 for example a storage-programmable control. A measuring value transmitter 32 is connected with the screwing control 31 and controls the measuring values of torque and/or rotary angle determined at the wrench wheel 5. The screwing control 31 regulates the output part 33 which supplies current to the electric motor 25.

Before the beginning of a screwing process the wrench wheel 5 is brought to the position shown in the drawing with the wrench opening 7 which is open toward the recess 3. Shortly before reaching a preselected torque the screwing control 31 reduces the rotary speed of the motor 25. After reaching the preselected torque the electric motor 25 which acts on the driven shaft 17 is turned off by the control 31. In some cases the opening position is determined by a reverse rotation of the wrench wheel 5. Since the control 30 and 31 operate without delay and the electric motor does not have post-running, the wrench wheel 5 is exactly kept in the opening position. The wrench can now be removed manually or automatically. When it is necessary to maintain a narrow tolerance with a required torque, the finding of the open wrench position can be performed after a lateral removal from the nut or screw 6 to be screwed.

By means of the controls 30 and 31 both right running and also left running of the wrench wheel 5 is possible without any delay. Due to the combination of the sensor 24 or 29, controls 30 and 31 and an electrically commutating motor 25 with extremely favorable dynamic properties, the movement of the wrench to the open position is made possible with high repeatable accuracy in condition of high rotary speed of the wrench. In contrast to conventionally open wrenches, the wrench in accordance with the present invention can be used in automatic devices with short cycle times.

It will be understood that each of the elements described above, or two or more together, may also find a useful application in other types of constructions differing from the types described above.

While the invention has been illustrated and described as embodied in a motor driven wrench, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A motor-driven wrench, comprising a housing having a recess forming a wrench opening; a rotatable wrench wheel supported in said housing, said wrench wheel having a wrench wheel opening and an engaging formation, said wrench opening and said wrench wheel opening being in alignment; drive means for rotary driving said wrench wheel and having at least two engaging portions which engage said engaging formation of said wrench wheel and are spaced from one another by a distance which is greater than a width of said wrench opening; marking means identifying an open position of the wrench; and sensor means sensing a position of said marking means and thereby determining said open position of the wrench, said sensor means being formed to recognize said marking means in a contactless way and to produce an electrical signal for stopping a rotation of said wrench wheel in said open position of said wrench.

2. A motor-driven wrench as defined in claim 1, wherein said engaging formation is a friction surface provided in said wrench wheel.

3. A motor-driven wrench as defined in claim 1, wherein said engaging formation is a toothing provided in said wrench wheel.

4. A motor-driven wrench as defined in claim 1, wherein said drive means has two friction wheels having said engaging portions.

5. A motor-driven wrench as defined in claim 1, wherein said drive means has two toothed wheels having said engaging portions.

6. A motor-driven wrench as defined in claim 1, wherein the width of said wrench opening substantially corresponds to a width of said wrench wheel opening.

7. A motor-driven wrench as defined in claim 1, wherein said drive means has two engaging wheels having said two engaging portions, and a joint drive wheel which cooperates with said two engaging wheels.

8. A motor-driven wrench as defined in claim 7, wherein said drive means has a plurality of driving wheels arranged in a row and forming a drive train connected with and driving said joint drive wheel.

9. A motor-driven wrench as defined in claim 7, wherein said drive means includes an electrically commutating motor operative for driving said engaging wheels.

10. A motor-driven wrench as defined in claim 1, wherein said marking means is formed as metal pin means.

11. A motor-driven wrench as defined in claim 1, wherein said sensor means is mounted in said housing.

12. A motor-driven wrench as defined in claim 1, wherein said drive means has a drive train for driving said wrench wheel, said marking means being provided in said drive train.

13. A motor-driven wrench as defined in claim 1, wherein said marking means is arranged on said wrench wheel.

14. A motor-driven wrench as defined in claim 13, wherein said marking means is arranged on said wrench wheel at a side which is opposite to said wrench opening.

15. A motor-driven wrench as defined in claim 1, wherein said drive means includes a driven wheel of a motor, said marking means being arranged for joint rotation with said driven wheel of said motor.

16. A motor-driven wrench as defined in claim 1, wherein said drive means includes a motor provided with a shaft, said marking means being arranged on said shaft of said motor.

17. A motor-driven wrench as defined in claim 1; and further comprising electronic operational control means receiving said signal of said sensor means and automatically controlling a rotary direction of said drive means and thereby said wrench wheel with consideration of a position of said wrench wheel.

* * * * *